United States Patent [19]

Loyola

[11] 4,392,126

[45] Jul. 5, 1983

[54] COMBINATION BUCKLE AND WAIST ALARM

[76] Inventor: Luis A. Loyola, 851 W. End Ave., New York, N.Y. 10025

[21] Appl. No.: 165,270

[22] Filed: Jul. 2, 1980

[51] Int. Cl.[3] ..... G08B 21/00

[52] U.S. Cl. ..... 340/573; 128/782; 340/668

[58] Field of Search ..... 340/573, 668, 665; 128/782, 774; 200/61.14, 61.4, DIG. 2

[56] References Cited

U.S. PATENT DOCUMENTS

| | | | |
|---|---|---|---|
| 3,582,935 | 10/1968 | Verhaeghe | 340/668 |
| 3,642,276 | 2/1972 | Kropf | 128/782 |
| 3,670,320 | 6/1972 | Palmer | 340/573 |
| 3,918,301 | 11/1975 | Baer | 340/668 |
| 4,191,949 | 3/1980 | Myers | 200/DIG. 2 |

*Primary Examiner*—Glen R. Swann, III

*Attorney, Agent, or Firm*—Philip Furgang

[57] ABSTRACT

A combined alarm and belt buckle is provided in which the legs of a first U-shaped member are slidable through spaced apertures in a hollow buckle housing. The cross-bar of the first U-shaped member serves to be engaged by a clip on the free end of a belt. Springs are disposed about each leg of the first U-shaped member. The springs are held in place by a second U-shaped member within the housing. The legs of the second U-shaped member are secured to the legs of the first U-shaped member at the ends thereof. An electrical contact is secured to the housing and is in registry with a second contact on the second U-shaped member. The contacts are coupled through a switch and battery to an alarm. When pressure is exerted upon the first U-shaped member, the bar moves outwardly, the contacts join, and an alarm sounds. Alternatively, the wearer may close the switch, turning off the alarm.

15 Claims, 4 Drawing Figures

COMBINATION BUCKLE AND WAIST ALARM

BACKGROUND OF THE INVENTION

This invention relates to alarm devices and, more particularly, alarms coupled to a belt to issue an alarm upon a change in the dimension of the waist of the wearer.

Alarm devices have been previously proposed. These alarm devices, however, have been used to improve the posture of the wearer. Thus, for example, Verhaeghe, in U.S. Pat. No. 3,582,935, provides for a housing secured to the belt of a wearer. The housing is hollow and has an aperture on the housing wall adjacent to the waist of the wearer. Within the housing are an alarm buzzer and a battery. An electrical switch is secured to the housing and provided with a contact arm which is secured to the housing and extends into the aperture and abuts the waist of the wearer. Any expansion of the abdomen, as caused, for example, by a change in the posture of the wearer, causes the contact arm to be moved outwardly with reference to the wearer, thereby closing the switch and energizing the alarm. The disadvantage of this device is that if the enlargement of the waist is not as a result of a change in posture, or if the expansion is not directly outwardly at the location of the contact arm, the alarm will not sound. Ordinarily, as a waist expands, the pulling on a belt would be circumferential with respect to the waist. In such an instance, the device proposed by Verhaeghe will be unlikely to issue an alarm.

Palmer, in U.S. Pat. No. 3,670,320, proposes a similar device to that proposed by Verhaeghe. Palmer's device provides a housing to which both ends of a belt are attached. The free ends of the belt, however, are attached to a buckle which is secured at the back of the user—a decided disadvantage. In the alarm housing is an L-shaped arm, to one leg of which is attached one part of the belt. Another leg of the arm is secured asymmetrically within the housing and is held in position slidably between studs and a support wall within the housing. The end of the leg within the housing is connected to the housing by a coiled spring. Attached to the leg is a contact arm. As the belt moves outwardly, due to the expansion of the waist of the user, the contact engages a switch. Closing the switch completes a circuit which includes an alarm. The device disclosed is bulky, providing a battery holding chamber on the exterior of the belt and the alarm in a chamber between the belt and the wearer.

Both devices have in common certain disadvantages. They do not serve as a belt buckle, but, rather, are housings which are separately securable to a belt. This draws attention to the fact that the wearer is using a separate device for some specialized purpose—a purpose that the wearer may not wish to publicize. Further, each of the above-discussed devices is less concerned with the actual size of a waist than with good posture. For that reason, each measures a uni-directional force. In Verhaeghe, the force must be outwardly with respect to the wearer and at the location of the contact. In Palmer, the force must be circumferential. Non-circumferential forces will cause the arm of the L-shaped member to engage the studs, thereby restricting movement and providing a false reading. Further, each of these devices is in a constant active state.

SUMMARY OF THE INVENTION

It is an object of this device to provide a dual purpose belt buckle which serves both to hold a belt and provide means for sounding an alarm, indicating the undesired expansion of the waist of the wearer.

It is another object of this invention to provide a dual purpose buckle which may selectively serve as a belt buckle and as a buckle alarm to indicate an expansion of the waist of the wearer.

It is a further object of this invention to provide a belt buckle alarm which may accurately transmit the expansion of the waist of a wearer, irrespective of the angle and location of the expansion.

It is yet another object of this invention to provide a combination belt buckle alarm which is economic to manufacture and simple and convenient to use.

It is still another object of this invention to provide an alarm device which responds to multi-directional expansion forces of the waist of a wearer.

In accordance with the teachings of this invention, there is provided an alarm of the type intended to indicate the expansion of a waist and used in combination with a belt, the alarm being of the type intended to issue a sound upon the expansion of the waist of the wearer. The alarm includes hollow housing. The housing has spaced apertures. A member is provided having spaced, substantially parallel, extending legs. The legs extend through the aperture and are slidably secured to the housing. Resilient means are provided within the housing for engaging the legs and urging the legs uniformly into the housing. Alarm means are provided for electrically providing an alarm. Electrical circuit means, responsive to a source of electrical energy, couple the alarm means to the legs, such that, upon the legs being pulled outwardly to a predetermined position, the alarm means are electrically excited. The legs, in combination with the apertures, move with respect to the housing, to thereby give a reliable indication of waist expansion and contraction.

DESCRIPTION OF THE PREFERRED EMBODIMENT

Figure 2:
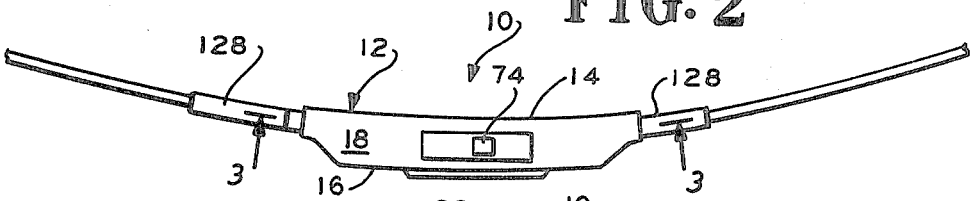
FIG. 2 is a side view of the buckle of FIG. 1.

Turning to the drawing, in which like numerals throughout identify the same or similar parts, there is disclosed a combination alarm device and belt buckle 10. A housing 12 is provided which may have any convenient shape—for example, it may have a generally rectangular shape. The housing 12 thus may include a planar rear wall 14 (shown in edge view in FIG. 2), an opposed front wall 16, a top wall 18, an opposed planar bottom wall 20, and two opposed side walls 22 and 24. These walls 16, 18, 20, 22, and 24 may be made of any convenient structural material, such as metal or plastic, and define a thin, buckle-like hollow housing 12.

Figure 3:
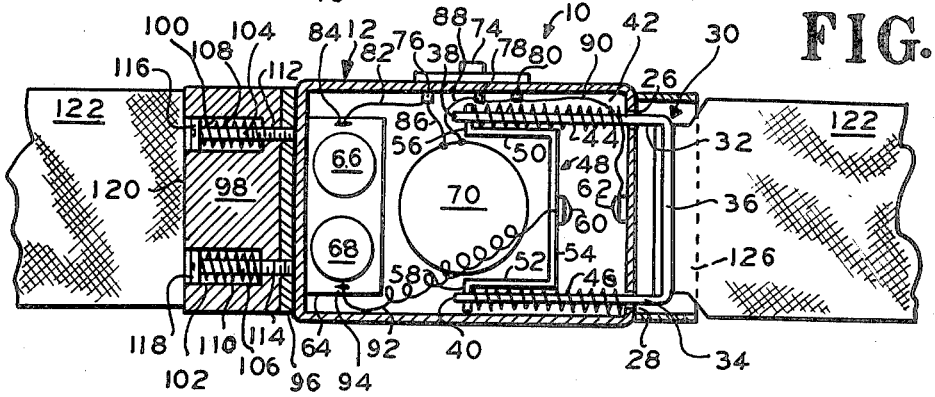
FIG. 3 is a sectional view taken along lines 3—3 in FIG. 2.
Figure 4:
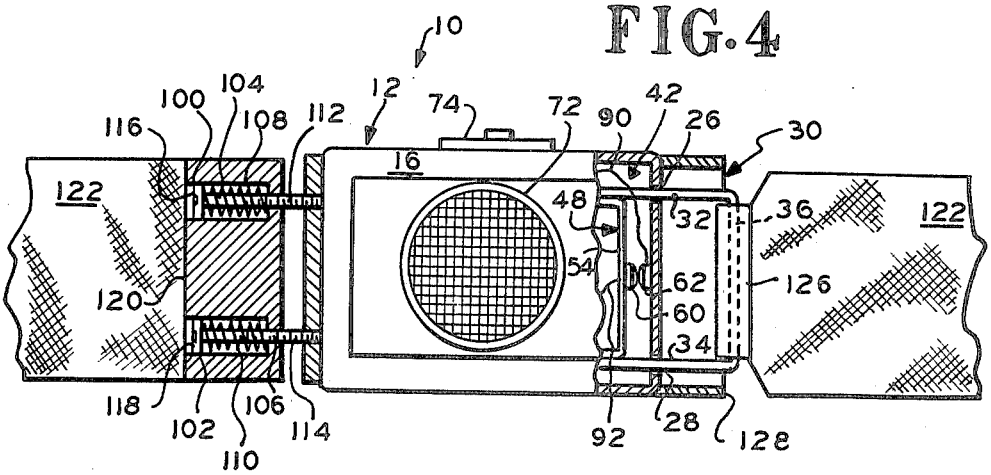
FIG. 4 is a partially sectioned view of the buckle of FIG. 1.

The front wall 16 of the housing 12 may have a decorative buckle-like finish. Thus, for example, the front wall 16 may be furnished with a chamfer-like frame, as is well known in the art. Indeed, any form of decorative buckle-like front may be employed. In addition, as with many buckle devices, at least the rear wall 14, and perhaps its parallel wall 16, may be slightly arcuate so as to accommodate the curve of the waist of the wearer (not shown). Through one side wall 24, and symmetrically disposed, may be two apertures 26 and 28 (FIGS. 3 and 4). Extending through the apertures 26 and 28 may be a first substantially U-shaped member 30 (FIGS. 3 and 4). The first U-shaped member 30 may comprise two spaced legs 32 and 34 and a cross-bar 36 (FIG. 3), which completes the U-shape. The legs 32 and 34 are so dimensioned as to fit through and be loosely slidable in the apertures 26 and 28 of the housing 12. The free ends 38 and 40 of each leg 32 and 34, respectively, may be within the interior 42 (FIGS. 3 and 4) of the housing 12.

About each leg 36 and 38 may be disposed a coiled spring 44 and 46, respectively (FIG. 3). The first U-shaped member 30 may be made of any structural material, such as metal, plastic, or the like. A second U-shaped member 48 may be within the interior 42 of the housing 12. The second U-shaped member 48, like the first, is comprised of two legs 50 and 52 and a cross-bar 54, to complete the U-shape.

The second U-shaped member 48 is so dimensioned and disposed that its cross-bar 54 is parallel to the cross-bar 36 of the first U-shaped member 30 and between the legs 32 and 34 of the first U-shaped member 30. The legs 50 and 52 of the second U-shaped member 48 may be parallel to the legs 32 and 34 of the first U-shaped member 30. The free ends 56 and 58 of the legs 50 and 52, respectively, of the second U-shaped member 48 may be bent laterally outwardly so as to engage and be secured to the free ends 38 and 40 of the legs 32 and 34, respectively, of the first U-shaped member 30. The two U-shaped members 30 and 48 may be thus joined to one another by any convenient means, such as glue, welding, or the like. Thus secured, the second U-shaped member 48 retains the springs 44 and 46 on the legs 32 and 34 and against the side wall 24 of the housing 12.

In the interior 42 of the housing 12, and secured to the side wall 24, may be an electrical contact 62. The contact 62 is constructed in a manner well known in the art. If the housing 12 is metallic, then the contact 62 is preferably insulated from the wall 24 by means of a plastic material, such as a phenolic, or the like. The contact 62 may be secured to the wall by any adhesive method, such as by the use of epoxy, or the like, as is well known.

Secured to the cross-bar 54 of the second U-shaped member 48 may be a second contact 60. The second contact 60 may be insulated from the cross-bar 54 by means well known in the art and as discussed in connection with the attachment of the first contact 62 to the side wall 24 of the housing 12. The contacts 62 and 60 are opposed to and in registry with one another. The function of the two opposed contacts 62 and 60 will be discussed more fully hereinafter.

The two U-shaped members 30 and 48 may have any desired shape. Preferably, the first U-shaped member 30 may be rod-like in shape, while the second U-shaped member 48 may be constructed of generally planar members to allow for convenient mounting of the second electrical contact 60.

Mounted within the interior 42 of the housing 12 and adjacent to the opposed side wall 22 may be a battery holder 64 of well known construction. The battery holder 64 may be of any convenient or desired shape—preferably, a battery holder of the type intended to hold two mercury cells 66 and 68.

An alarm buzzer 70, or similar device, as is well known in the art, may be secured within the interior 42 of the housing 12 and to the front wall 16. The alarm or buzzer 70 may be of a type which is electrically excitable, as is well known in the art. The front wall 16 of the housing 12 may be furnished with a grid-like opening 72, the function of which will be discussed hereinafter. However, it should be noted that the buzzer 70 is directly aligned with this grid opening 72. The buzzer 70 may be secured to the front wall 16 by any well known means, such as by screws, adhesive, or the like.

An aperture (not visible) may be formed in the top wall 18 of the housing. A switch 74, which is preferably a two-position switch, may be secured to the top wall 18 of the housing 12 by any well known means, such as screws, adhesive, or the like. The three electrical terminals 76, 78, and 80 of the switch 74 may be disposed through the aperture in the top wall 18 into the interior 42 of the housing 12 (FIG. 3). A first wire 82 may couple a first battery terminal 84 to the first terminal 76 of the switch 74. A second wire 86 may be connected to the first terminal 76 and to the buzzer 70. A third wire 88 may connect the alarm 70 to the second terminal 78 of the switch 74. A fourth wire 90 may connect the second terminal 76 of the switch 74 to the first electrical contact 60 attached to the wall 24 of the housing 12. A fifth wire 92 may connect the other battery terminal 94 to the second electrical contact 62.

Secured to one side wall 22 opposed to the side wall 24 having the apertures 26 and 28 therein may be a mounting bar 96. The mounting bar may be of any material, such as metal or plastic, and may be secured to the side wall 22 by any joining means, such as adhesive, or the like. Two spaced threaded apertures may extend perpendicularly with respect to the side wall 22 and through the bar 96. A substantially rectangular rigid member 98, which may be made of metal, plastic, or the like, may be provided with countersunk apertures therein 100 and 102. Each countersunk aperture 100 and 102 is aligned with the apertures in the member 98. Screws 104 and 106 may have coiled springs 108 and 110 about the respective threaded shafts 112, 114. The heads 116 and 118 of each screw 104 and 106 are so dimensioned as to hold the springs 108 and 110 and fit within the countersunk apertures 100 and 102. The threaded shafts 112 and 114 pass through the member 98 and engage the threaded aperture in the bar 96.

Figure 1:
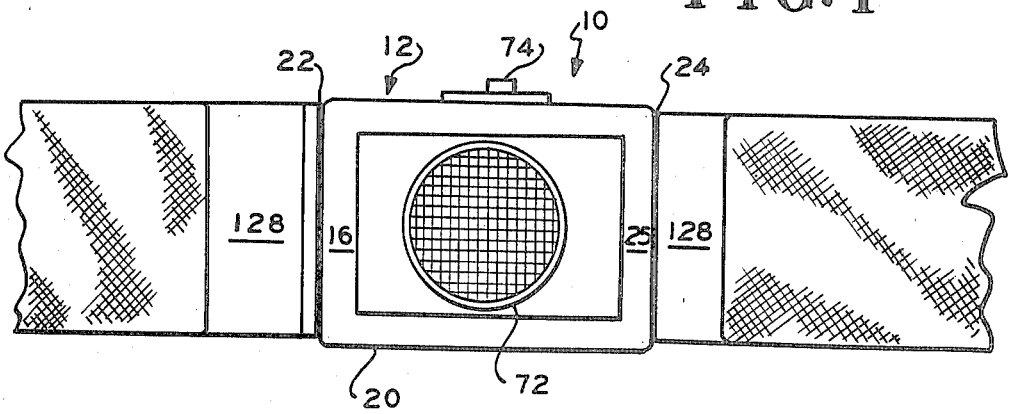
FIG. 1 is a front view of the alarm buckle, constructed in accordance with the teachings of this invention.

Secured to the member 98, by any convenient means, such as a clamp or other joining means, may be one end 120 of a belt 122. The other free end 124 of the belt 122 may be furnished with a clip 126 secured thereto in a manner well known in the art. Secured to the end walls 22 and 24 may be rectangular cover members 128 and 130 (FIG. 1). These members 128 may be aligned with the end of the buckle 10 and are intended to obscure the member 98 and the clip end 126 and cross bar 36 from view.

In use, batteries 66 and 68 may be inserted through a convenient opening (not shown) in the rear wall 14. The belt 122 encircles the wearer (not shown) and the clip end 126 engages the cross bar 36. The tension of the springs 44 and 46, 108 and 110 may be adjusted so that, when placed about the wearer, the bar 38 is as shown in FIG. 3 with the electrical contacts 60 and 62 spaced apart. When the wearer's waist expands in any direction, the first U-shaped member 30 moves outwardly. It carries with it the cross bar 54 of the second U-shaped member 48. When the two contacts 60 and 62 engage, an electrical circuit is set up between the batteries 66 and 68, along the fifth wire 92, through the contact 62 and the contact 60, along the second wire 86, through the switch 74, via the terminal 78, to the alarm 70 and through terminal 76 to the battery contact 84. An alarm will sound. Once the waist of the wearer returns to normal, the contacts 60 and 62 will separate. By adjustment of either the screw 104 or 106 or the adjustment of the tension of the springs 44 and 46, 108 and 110, the buckle 10 may be adjusted for any wearer.

In the prior art devices, the means for sensing a change in the condition of the waist of the wearer was uni-directional. By permitting "play" in the legs 32 and 34, in combination with the apertures 26 and 28, any multi-directional force will translate into movement of the legs with respect to the housing 12. The legs 32 and 34 are, therefore, able to pivot to at least an acute angle about their respective axes. As the first U-shaped member 30 is pulled outwardly with respect to the housing 12, the tension of the springs 44 and 46 increases. When the force subsides, the springs separate the electrical contacts 60 and 62. If the wearer wishes to avoid operating the alarm, the switch 74 may be closed, shorting the two terminals 76 and 78, thereby preventing electrical current from reaching the alarm 70.

The grid-like opening 72 may be a convenient method of allowing the sound of the alarm to escape the housing 12.

This is a matter of choice, and apertures may be provided elsewhere in the housing 12.

The combination of buckle and alarm allows the wearer to maintain the privacy of the alarm by merely switching off the alarm.

What is claimed is:

1. An alarm device of the type intended to indicate the expansion of the waist of a wearer and used in combination with a belt, said alarm device comprising:

(a) a hollow housing;

(b) a member;

(c) a pair of spaced legs formed integrally with and extending from said member; said housing having a pair of spaced apertures for receiving therethrough and into said housing the free ends of said legs; said member being exterior to said housing; said apertures being so dimensioned that said legs may be pivoted to an acute angle with respect to axes extending perpendicularly to the housing and through the center of said apertures;

(d) resilient means within said housing and engaging said legs for urging said legs into said housing; said resilient means comprising coiled springs about each of said legs;

(e) an alarm;

(f) electrical circuit means for coupling electrical energy to said alarm upon said legs being pulled outwardly to a predetermined position with respect to said housing; and (g) switch means for selectively disconnecting said electrical circuit means from said alarm.

2. An alarm device as recited in claim 1 wherein said electrical circuit means comprises second member means secured across and to said legs and an electrical contact secured to said second member means; said springs being held in position upon said legs by abutting, at one end, said housing and, at the opposed end, said member means; said member means being movable with respect to said housing.

3. An alarm device as recited in claim 2 wherein said electrical circuit means further comprises a second electrical contact spaced from and in registry with said first-recited electrical contact such that, upon said legs reaching said predetermined position, said contacts touch to thereby complete said electrical circuit.

4. An alarm device as recited in claim 3 wherein said second member means comprises a substantially U-shaped member disposed between said legs with the legs of said U-shaped member arranged parallel to said first-recited legs; said second contact being secured to said housing; said first contact being secured to the cross-bar of said U-shaped member.

5. An alarm device as recited in claim 4 wherein said electrical circuit further comprises a source of electrical energy coupled by said contacts to said alarm; said switch in a first position preventing current from reaching said alarm and in a second position permitting current to reach said alarm.

6. An alarm device as recited in claim 5 wherein said member and said first-recited legs, in combination, define a second U-shaped member; one end of the belt being securable to said housing; the other free end of the belt releasably engaging said member of said second U-shaped member, thereby defining a buckle.

7. An alarm device as recited in claim 6 wherein said housing comprises a substantially rectangular shape with said first-recited U-shaped member legs entering through said apertures in one side thereof; the other end of the belt being secured to the opposed side.

8. A buckle as recited in claim 7 wherein said secured end of said belt further comprises a belt member having countersunk apertures therein; two screw-like members within said countersunk apertures and extending without said belt member and joining said belt member to said housing; a spring about each of said screw-like members, the head of each screw-like holding said spring in place to thereby provide a yieldable juncture of the belt end to said housing; and further comprising a clip securable to the free end of the belt for engaging the cross-bar of said second U-shaped member.

9. An alarm device as recited in claim 2 wherein said hollow housing comprises a buckle housing; one end of the belt being fixedly securable to the housing; and a clip secured to the free end of the belt for engaging said member, thereby completing a belt buckle.

10. A buckle of the type intended to engage a belt and to which one end of the belt is secured, said buckle comprising:

(a) a substantially rigid hollow buckle housing to which one end of the belt is securable;

(b) a bar member extending from the exterior to within said buckle housing and slidable within and with respect to said buckle housing for being engaged by the free end of the belt to thereby complete the buckle; said bar member comprises a substantially U-shaped member, said housing having two spaced apertures through which pass the legs of said U-shaped member;

(c) resilient means within said housing for engaging said bar member and urging said bar member into said housing; said resilient means comprising coiled springs about each of said legs of said and means for holding said springs upon said legs of said screw-like U-shaped member; and (d) alarm means within said housing and coupled to said bar member such that, upon said bar member being withdrawn from said housing to a predetermined position with respect to said housing, said alarm being sounded.

11. A buckle as recited in claim 10 wherein said alarm means comprises an electrical circuit responsive to said position of said legs of said U-shaped member with respect to said buckle housing.

12. A buckle as recited in claim 11 wherein said means holding said springs comprises a second member secured to the free ends of said legs of said U-shaped member and a wall of said housing; said electrical circuit comprises a pair of spaced electrical contacts in registry with one another, one of said electrical contacts being secured to said second member such that, upon said legs of said U-shaped member reaching said predetermined position, said electrical contacts touch, thereby initiating said alarm.

13. A buckle as recited in claim 12 wherein said buckle housing is substantially rectangular with one belt end secured to a first side wall of said housing and said apertures being through a side wall opposed to said first side wall; said electrical circuit further comprising a switch for selectively disabling said alarm.

14. A buckle as recited in claim 13 wherein said secured end of said belt further comprises a belt member having countersunk apertures therein; two screw-like members within said countersunk apertures and extending without said belt member and joining said belt member to said housing; a spring about each of said screw-like members, the head of each screw-like member holding said spring in place to thereby provide a yieldable juncture of the belt end to said housing; and further comprising a clip securable to the free end of the belt for engaging the cross-bar of said U-shaped member.

15. An alarm device of the type intended to indicate the expansion of the waist of the wearer and used in combination with a belt, said alarm device comprising:

(a) a hollow housing;

(b) a member;

(c) at least a first pair of spaced legs formed integrally with and extending from said member; said housing having a pair of spaced apertures for receiving therethrough and into said housing the free ends of said legs; said member being exterior to said housing;

(d) an alarm;

(e) electrical circuit means for coupling electrical energy to said alarm upon said first legs being pulled outwardly to a predetermine position with respect to said housing; said electrical circuit means comprising member means secured across and to said first legs; a first electrical contact secured to said member means; a second electrical contact secured to said housing and spaced from and in registry with said first electrical contact such that, upon said legs reaching said predetermined position, said first and second contacts touch to thereby complete said electrical circuit; and (f) resilient means with said housing and engaging said legs for urging said first legs away from said predetermined position.

* * * * *